US005472375A

United States Patent [19]

Pugh

[11] Patent Number: 5,472,375

[45] Date of Patent: Dec. 5, 1995

[54] BLADE SHARPENING ANGLE GUIDE

[76] Inventor: Robert S. Pugh, 9210 Bloomdale St., Santee, Calif. 92071

[21] Appl. No.: 164,970

[22] Filed: Dec. 10, 1993

[51] Int. Cl.[6] ..... B24B 19/00

[52] U.S. Cl. ..... 451/367; 451/371; 451/386

[58] Field of Search ..... 451/367, 369, 451/370, 371, 378, 386, 557, 558, 391

[56] References Cited

U.S. PATENT DOCUMENTS

| | | | |
|---|---|---|---|
| 2,437,495 | 3/1948 | Anderson | 451/371 |
| 2,631,415 | 3/1953 | Allers | 451/371 |
| 2,950,585 | 8/1960 | Bell | 451/371 |
| 3,654,823 | 4/1972 | Juranitch | 451/371 |
| 3,800,632 | 4/1974 | Juranitch | 451/371 |
| 3,924,360 | 12/1975 | Haille et al. | 451/371 |

*Primary Examiner*—Maurina T. Rachuba

[57] ABSTRACT

A new and improved blade sharpening angle guide for aligning and holding a knife blade or the like at a proper angle to a sharpening stone for manual sharpening of the cutting edge, the blade sharpening angle guide comprising: an elongated curved block having a longitudinal slot therethrough wherein a knife blade or the like may be releasedly held with the blade cutting edge extending a distance outside the slot whereby controlling the angle of the blade to a sharpening stone when the blade and block combination are drawn across the sharpening stone.

3 Claims, 4 Drawing Sheets

FIG. 1
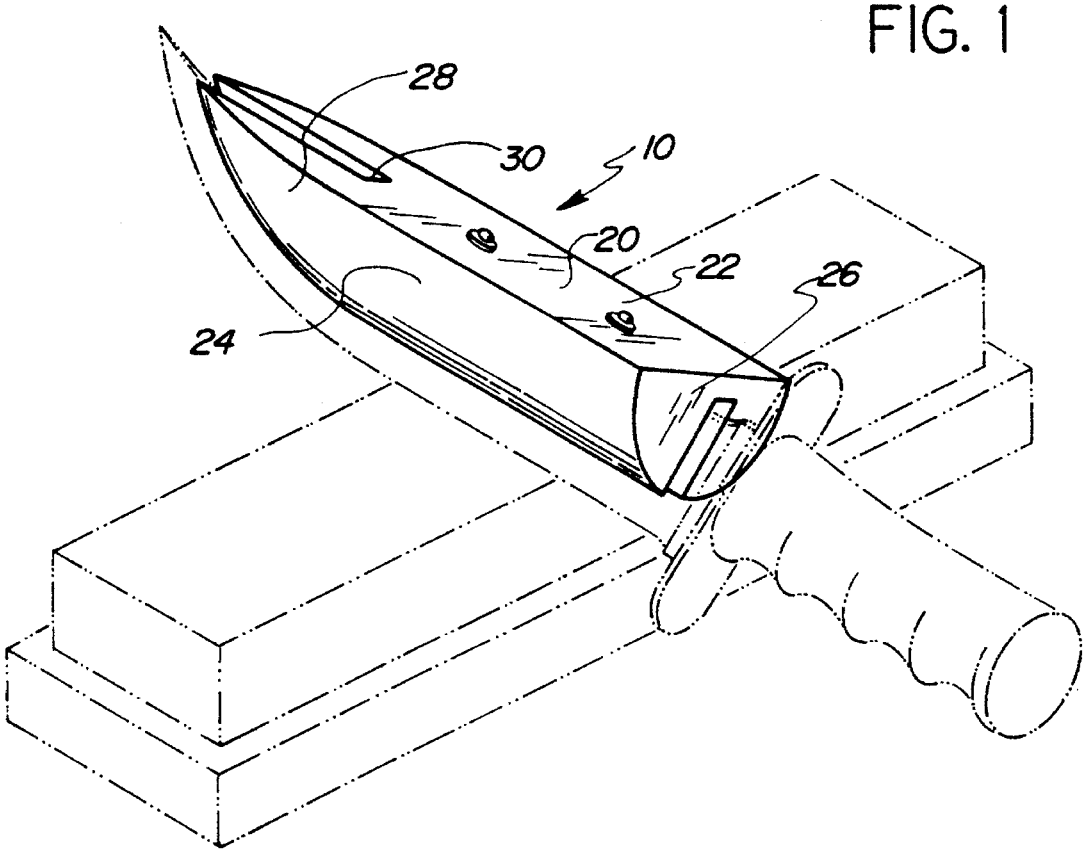
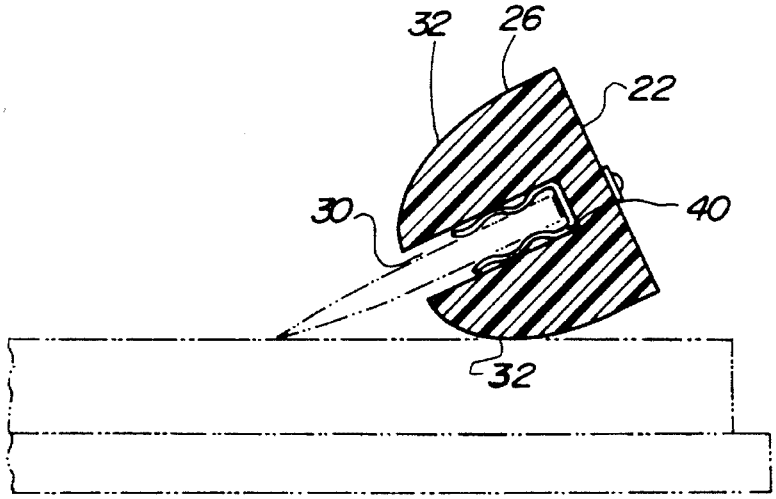
FIG. 2

FIG. 7
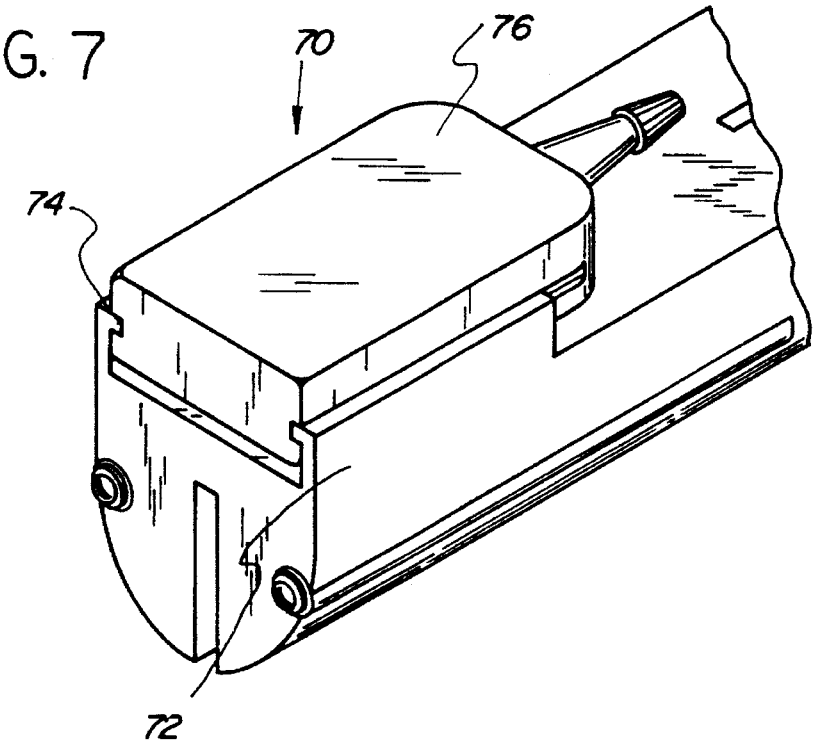
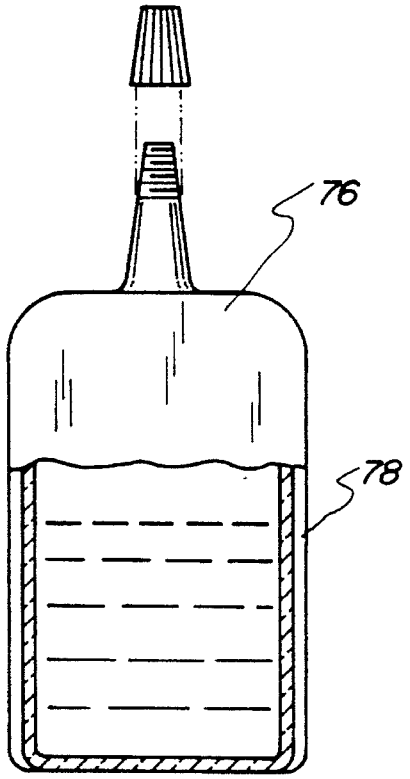
FIG. 8

BLADE SHARPENING ANGLE GUIDE

BACKGROUND OF THE INVENTION

1. Field of the Invention

The present invention relates to devices for holding knife blades at the proper angle for sharpening and more particularly pertains to blade sharpening angle guide which may be used for aligning and holding a knife blade or the like at a proper angle for manual sharpening of the cutting edge.

2. Description of the Prior Art

The use of blade sharpening angle guide is known in the prior art. More specifically, blade sharpening angle guide heretofore devised and utilized for the purpose of aligning and holding a knife blade or the like at a proper angle for manual sharpening of the cutting edge are known to consist basically of familiar, expected and obvious structural configurations, notwithstanding the myriad of designs encompassed by the crowded prior art which have been developed for the fulfillment of countless objectives and requirements.

The present invention is directed to improving devices for aligning and holding a knife blade or the like at a proper angle for manual sharpening of the cutting edge in a manner which is safe, secure, economical and aesthetically pleasing.

For example, U.S. Pat. No. 5,094,038 to Maruyama discloses a sharpening aid support device consisting of a solid block of rigid material having a flat lower surface and an upper surface with an elongated arcuate channel having two spaced apart lips extending horizontally along the upper edges of the channel and extending slightly inwardly toward each other.

U.S. Pat. No. 4,991,357 to Stickles, Sr. describes a knife sharpening kit which comprises a portable case that forms an elongated trough with outwardly flaring upper edge support surfaces for supporting a cutting stone and controlling the angle at which the knife blade contacts the cutting stone.

Both of the above referenced inventions adequately treat the straight portion of the knife blade cutting edge but neither discloses a way to accurately control the sharpening angle of the curved portion of the knife blade.

U.S. Pat. No. 4,866,845 to McEvily describes a knife holding and sharpening block for holding, storing and, if desired, sharpening knives. The device disclosed is not portable and, further, does not teach a method for applying honing oil during the sharpening operation.

The prior art also discloses a blade sharpener as shown in U.S. Pat. No. 5,138,801 to Anthon et al. which consists of a main body and a clamping bar for securing a blade to be sharpened, guide arms, a support rod, and a sharpening hone holder. The device disclosed consists of numerous parts making it difficult to use and expensive to manufacture.

In this respect, the blade sharpening angle guide according to the present invention substantially departs from the conventional concepts and designs of the prior art, and in so doing provides an apparatus primarily developed for the purpose of aligning and holding a knife blade or the like at a proper angle for manual sharpening of the cutting edge.

Therefore, it can be appreciated that there exists a continuing need for new and improved blade sharpening angle guide which can be used for aligning and holding a knife blade or the like at a proper angle for manual sharpening of the cutting edge. In this regard, the present invention substantially fulfills this need.

As illustrated by the background art, efforts are continuously being made in an attempt to develop devices for aligning and holding a knife blade or the like at a proper angle for manual sharpening of the cutting edge. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of blade sharpening angle guide now present in the prior art, the present invention provides an improved blade sharpening angle guide construction wherein the same can be utilized for aligning and holding a knife blade or the like at a proper angle for manual sharpening of the cutting edge. As such, the general purpose of the present invention, which will be described subsequently in greater detail, is to provide a new and improved blade sharpening angle guide apparatus and method which has all the advantages of the prior art blade sharpening angle guide and none of the disadvantages.

The invention is defined by the appended claims with the specific embodiment shown in the attached drawings. For the purpose of summarizing the invention, the invention may be incorporated into a new and improved blade sharpening angle guide for aligning and holding a knife blade or the like at a proper angle to a sharpening stone for manual sharpening of the cutting edge, the blade sharpening angle guide comprises an elongated block formed of rigid smooth abrasion-resistant material. The block has a planar top and an arcuate bottom whereby a semicircular cross-section is formed. The block also has a square first end and a curved second end whereby a point is formed. The block further has a longitudinal slot formed radially to the arcuate bottom whereby a knife blade or the like may be received, the longitudinal slot also being formed orthoganally to the planar surface of the top. The block has two shoulders defined by the arcuate portions on both sides of the longitudinal slot whereby two sharpening stone bearing surfaces and are formed. The elongated block moreover has two identical spaced apart lateral holes therethrough, the holes being orthogonal to the planar surface of, and extending from, the planar surface of the block to the inside of the longitudinal slot. The blade sharpening angle guide also has blade retaining clip means comprised of a pair of identical channel-shaped spring members and fixedly longitudinally disposed within the longitudinal slot. The spring members have a spine and two identical inwardly biased denticulated arms wherein a knife blade or the like may be frictionally removedly retained. The spring members also have a mounting hole and formed through the spine, the mounting hole having the same diameter as the diameters of the two lateral holes through the block. The blade sharpening angle guide further has blade retaining clip fastening means comprising a pair of identical rivets having a diameter essentially the same as the diameter of the mounting holes through the spring members and a first pair of identical flat washers having an inside diameter essentially the same as the diameter of the mounting holes through the spring members. The rivets each extend through the mounting holes of one of the spring members and also through one of the lateral holes in the block. The rivets additionally each extend through one flat washer of the first pair of flat washers and have both ends formed to fixedly capture the spring members within the longitudinal groove of the block.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved blade sharpening angle guide for aligning and holding a knife blade or the like at a proper angle to a sharpening stone for manual sharpening of the cutting edge, the blade sharpening angle guide comprising an elongated curved block having a longitudinal slot therethrough wherein a knife blade or the like may be releasedly held with the blade cutting edge extending a distance outside the slot whereby controlling the angle of the blade to a sharpening stone when the blade and block combination are drawn across the sharpening stone.

An even further object of the present invention is to provide a new and improved blade sharpening angle guide which is susceptible of a low cost of manufacture with regard to both materials and labor, and which accordingly is then susceptible of low prices of sale to the consuming public, thereby making such blade sharpening angle guide s economically available to the buying public.

Still yet another object of the present invention is to provide a new and improved blade sharpening angle guide which provides in the apparatuses and methods of the prior art some of the advantages thereof, while simultaneously overcoming some of the disadvantages normally associated therewith.

Still yet another object of the present invention is to provide a new and improved blade sharpening angle guide which is light weight and portable.

Yet another object of the present invention is to provide a new and improved blade sharpening angle guide which can accurately control the sharpening angle along the curved portion of a knife blade Even still another object of the present invention is to provide a new and improved blade sharpening angle guide which includes a honing oil dispenser and dispenser storage means.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the invention illustrating its manner of use with a hunting knife and sharpening stone.

FIG. 2 is a partial sectional view of the invention of FIG. 1 taken along the line 2—2.

5 taken along the line 6—6 and depicting the manner in which the rollers are mounted.

Figure 3:
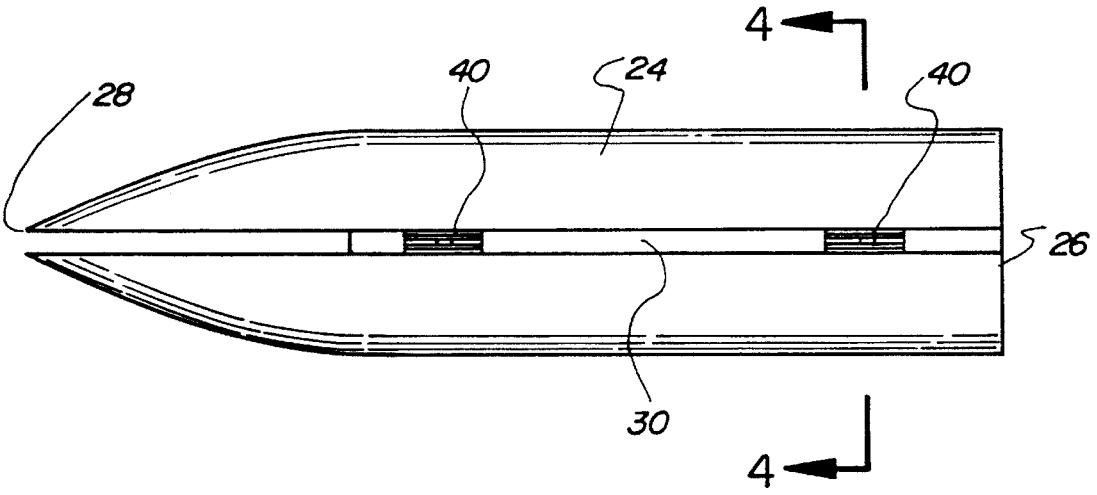
FIG. 3 is a bottom plan view of the invention of FIG. 1 showing the longitudinal slot with blade retaining clips.
Figure 4:
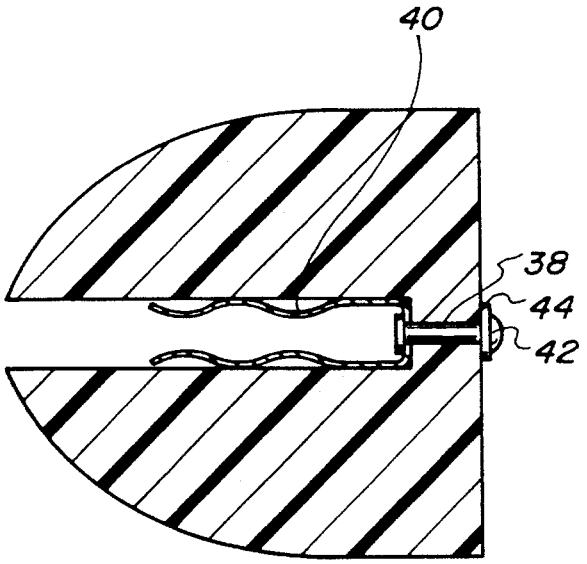
FIG. 4 is a sectional view of the invention of FIG. 3 taken alone the line 4—4 and illustrating the blade retaining clip fastening means.
Figure 5:
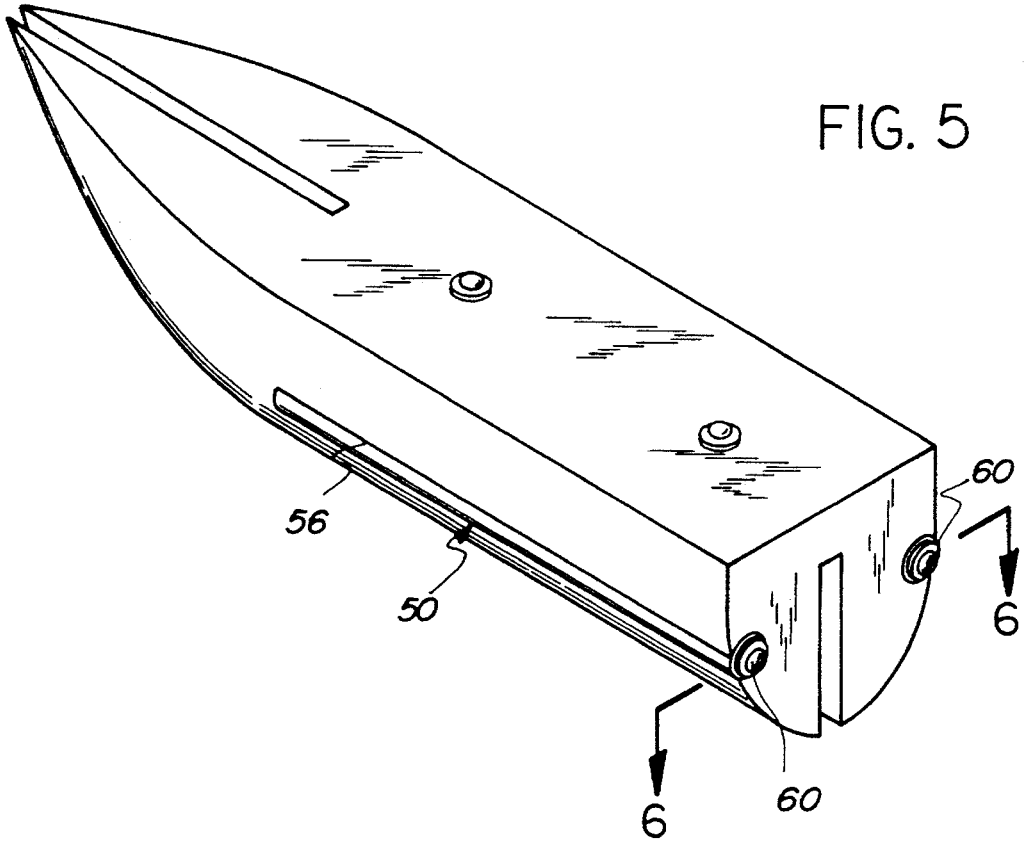
FIG. 5 is a perspective view of an alternate embodiment of the invention of FIG. 1 showing the abrasion-reducing rollers.

FIG. 7 is a partial perspective view of a second modification of the alternate embodiment of the invention of FIG. 5 showing a honing oil dispenser squeeze bottle along with a method for removably mounting the dispenser on the elongated block.

FIG. 8 is a cutaway exploded detail view of the honing oil dispenser squeeze bottle of FIG. 7 in which the see-through container, the formed grooves, the threaded spout, and the threaded cap are illustrated.

DESCRIPTION OF THE PREFERRED EMBODIMENT

With reference now to the drawings, and in particular to FIG. 1 thereof, a new and improved blade sharpening angle guide embodying the principles and concepts of the present invention and generally designated by the reference numeral 10 will be described.

From an overview standpoint, the blade sharpening angle guide is adapted for use for aligning and holding a knife blade or the like at a proper angle for manual sharpening of the cutting edge. See FIG. 1.

With reference now to FIGS. 1 through 4, more specifically, it will be noted that the new and improved blade sharpening angle guide 10 aligns and holds a knife blade or the like at a proper angle to a sharpening stone for manual sharpening of the cutting edge. The blade sharpening angle guide 10 comprises an elongated block 20 formed of rigid smooth abrasion-resistant material. The block 20 has a planar top 22 and an arcuate bottom 24 whereby a semicircular cross-section is formed. The block also has a square first end 26 and a curved second end 28 whereby a point is formed. The block 20 further has a longitudinal slot 30 formed radially to the arcuate bottom whereby a knife blade or the like may be received, the longitudinal slot also being formed orthoganally to the planar surface of the top. The block 20 has two shoulders 32 defined by the arcuate portions on both sides of the longitudinal slot whereby two sharpening stone bearing surfaces are formed.

The elongated block moreover has two identical spaced apart lateral holes 38 therethrough, the holes being orthogonal to the planar surface of and extending from the planar surface of the block to the inside of the longitudinal slot.

The blade sharpening angle guide 10 also has blade retaining clip means 40 comprised of a pair of identical channel-shaped spring members fixedly longitudinally disposed within the longitudinal slot. The spring members have a spine two identical inwardly biased denticulated arms wherein a knife blade or the like may be frictionally removedly retained. The spring members also have a mounting hole formed through the spine the mounting hole having the same diameter as the diameters of the two lateral holes through the block.

The blade sharpening angle guide 10 further has blade retaining clip fastening means comprising a pair of identical rivet 40 and 42 having a diameter essentially the same as the diameter of the mounting holes through the spring members and a first pair of identical flat washers 44 having an inside diameter essentially the same as the diameter of the mounting holes through the spring members. The rivets each extend through the mounting holes of one of the spring members and also through one of the lateral holes in the block. The rivets additionally each extend through one flat washer of the first pair of flat washers and have both ends formed to fixedly capture the spring members within the longitudinal groove of the block.

Figure 6:
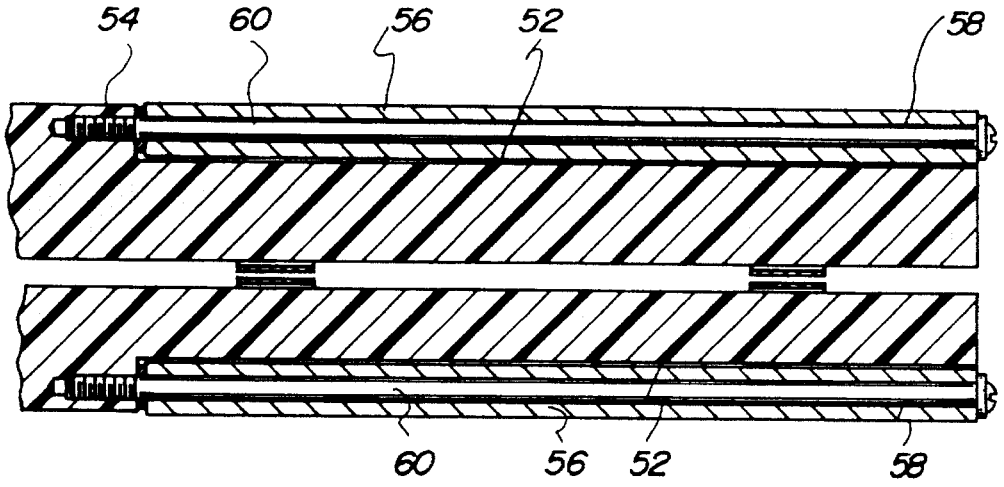
FIG. 6 is a partial sectional view of the invention of FIG.

In an alternate embodiment shown in FIGS. 5 and 6, and referring also to FIGS. 1 through 4, the elongated block additionally includes roller means 50 on the bearing surfaces of both shoulders to prevent abrasion of the block when the block is drawn across the sharpening stone. The roller means comprises a pair of identical tubular longitudinal cavities 52 formed within the straight portion of the shoulder of the block the cavities forming a rounded longitudinal slot having an opening along the length of the bearing surfaces. The tubular cavities extend from the surface of the square first end of the block to terminate with a blind end at the beginning point of the curve of the second end of the block.

The roller means further comprises a pair of identical threaded holes 54 formed in the block, each hole being located at the blind end of, and oriented colinear with, one of the tubular cavities. A pair of identical smooth hardened abrasion-resistant rollers 56 are additionally included, the rollers having a diameter essentially the same as the diameter of the tubular cavities formed in the block. The rollers also have a length essentially identical to the length of the tubular cavities formed in the block and additionally have a longitudinal hole 58 therethrough. The rollers are each disposed in one of the longitudinal tubular cavities of the block.

The alternate embodiment further includes a second identical pair and a third identical pair of flat washers having an inside diameter essentially the same as the diameter of the longitudinal hole through the rollers and an outside diameter substantially smaller than the outside diameter of the rollers. A pair of identical threaded bolts having a thread diameter and pitch essentially complementary to the diameter and pitch of the threaded holes of the block are also included. The threaded bolts have a body diameter essentially the same as the diameter of the longitudinal hole through the rollers. The threaded bolts each extend through one of the washers of the second pair of flat washers and also extend through the longitudinal hole in one of the rollers. The threaded bolts additionally each extend through one of the washers of the third pair of flat washers and threadedly engage with one of the threaded holes formed in the blind end of the longitudinal tubular cavity.

A first modification of the alternate embodiment, shown in FIGS. 7 and 8, of the blade sharpening angle guide 10 further includes a container means 70 for storing and dispensing honing oil. The container means comprises a pair of upstanding spaced apart longitudinal ears 72 formed on the planar surface of the elongated block. The ears extend approximately half the length of the elongated block. The ears each have a horizontal lip 74formed along the upper edge, the lips extending slightly inwardly toward each other whereby a mounting channel is formed.

The first modification also includes a squeeze bottle 76 formed of oil-resistant resilient transparent or translucent material such as plastic. The squeeze bottle has a width and depth to fit within the mounting channel of the elongated block The squeeze bottle also has a longitudinal grooves 78 formed along both edges, the grooves having a width and depth to releasably slippedly mate with the inwardly extending lips of the mounting channel of the elongated block. The squeeze bottle additionally has a threaded spout whereby controlled amounts dispensed. The squeeze bottle also has a threaded cap threadedly engaged with the threaded spout whereby unwanted spillage of the honing oil is precluded. The squeeze bottle is slippedly releasedly engaged with the mounting channel of the elongated block.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A blade sharpening angle guide for aligning and holding a knife blade at a proper angle to a sharpening stone for manual sharpening of the cutting edge, the blade sharpening angle guide comprising:

an elongated block formed of rigid smooth abrasion-resistant material having a planar top and an arcuate bottom whereby a semicircular cross-section if formed, the block also having a first end formed square, the block additionally having a second end formed curved whereby a point is formed, the block further having a longitudinal slot formed radially to the arcuate bottom whereby a knife blade may be received, the longitudinal slot also being formed orthogonally to the planar surface of the top, the block having two shoulders defined by the arcuate portions on both sides of the longitudinal slot whereby a sharpening stone bearing surface is formed, the elongated block moreover having two identical spaced apart lateral holes therethrough, the holes being orthogonal to the planar surface of the top, the holes extending from the planar surface of the block to the inside of the longitudinal slot;

blade retaining clip means comprising a pair of identical channel-shaped spring members fixedly longitudinally disposed within the longitudinal slot, the spring members having a spine and two identical inwardly biased denticulated arms wherein a knife blade may be frictionally removedly retained, the spring members also having a mounting hole formed through the spine, the mounting hole having the same diameter as the diameters of the two lateral holes through the block; and mounting means between the block and the spring means.

2. The blade sharpening angle guide of claim 1 wherein the elongated block additionally includes roller means on the bearing surfaces of both shoulders to prevent abrasion of the block when the block is drawn across the sharpening stone, the roller means comprising a pair of identical tubular longitudinal cavities formed within the straight portion of the shoulder of the block, the cavities forming a rounded longitudinal slot having an opening along the length of the bearing surface, the tubular cavities extending from the surface of the square first end of the block to terminate with a blind end at the beginning point of the curve of the second end of the block;

a pair of identical threaded holes formed in the block, each hole being located at the blind end of and oriented colinear with one of the tubular cavities;

a pair of identical smooth hardened abrasion-resistant rollers having a diameter essentially the same as the diameter of the tubular cavities formed in the block, the rollers also having a length essentially identical to the length of the tubular cavities formed in the block, the rollers additionally having a longitudinal hole therethrough, the rollers each being disposed in one of the longitudinal tubular cavities of the block;

a second identical pair of flat washers having an inside diameter essentially the same as the diameter of the longitudinal hole through the rollers, the second pair of flat washers also having an outside diameter substantially smaller than the outside diameter of the rollers;

a third identical pair of flat washers having an inside diameter essentially the same as the diameter of the longitudinal hole through the rollers, the third pair of flat washers also having an outside diameter substantially smaller than the outside diameter of the rollers; and a pair of identical threaded bolts having a thread diameter and pitch essentially complementary to the diameter and pitch of the threaded holes of the block, the threaded bolts having a body diameter essentially the same as the diameter of the longitudinal hole through the rollers, the threaded bolts each extending through one of the washers of the second pair of flat washers, the threaded bolts also each extending through the longitudinal hole in one of the rollers, the threaded bolts additionally each extending through one of the washers of the third pair of flat washers, the threaded bolts each further being threadedly engaged with one of the threaded holes formed in the blind end of the longitudinal tubular cavity.

3. The blade sharpening angle guide of claim 2 and further including a container means for storing and dispensing honing oil, the container means comprising:

a pair of upstanding spaced apart longitudinal ears formed on the planar surface of the elongated block, the ears extending approximately half the length of the elongated block, the ears each having a horizontal lip formed along the upper edge, the lips extending slightly inwardly toward each other whereby a mounting channel is formed; and a squeeze bottle formed of oil-resistant resilient transparent or translucent material such as plastic, the squeeze bottle having a width and depth to fit within the mounting channel of the elongated block, the squeeze bottle also having a longitudinal groove formed along both edges, the grooves having a width and depth to releasably slippedly mate with the inwardly extending lips of the mounting channel of the elongated block, the squeeze bottle additionally having a threaded spout whereby controlled amounts of the honing oil may be dispensed, the squeeze bottle also having a threaded cap threadedly engaged with the threaded spout whereby unwanted spillage of the honing oil is precluded, the squeeze bottle being slippedly releasedly engaged with the mounting channel of the elongated block.

* * * * *